US006189965B1

(12) United States Patent
Hecht et al.

(10) Patent No.: US 6,189,965 B1
(45) Date of Patent: Feb. 20, 2001

(54) CONVERTILE BENCH AND TABLE ASSEMBLY

(76) Inventors: Thomas R. Hecht, 37 Hemlock Acres, Manheim, PA (US) 17545; Howard F. Livingston, 1333 Beaconfield La., Lancaster, PA (US) 17601

( * ) Notice: Under 35 U.S.C. 154(b), the term of this patent shall be extended for 0 days.

(21) Appl. No.: 09/527,459

(22) Filed: Mar. 17, 2000

(51) Int. Cl.[7] ..... A47B 85/04
(52) U.S. Cl. ..... 297/124
(58) Field of Search ..... 297/118, 124, 297/125, 126, 127; 108/69, 77, 78

(56) References Cited

U.S. PATENT DOCUMENTS

| | | | | |
|---|---|---|---|---|
| 1,792,737 | * | 2/1931 | Greenstreet | 297/124 |
| 2,897,876 | * | 8/1959 | Austin | 297/124 X |
| 3,361,470 | * | 1/1968 | Gustin et al. | 297/124 |
| 4,194,784 | * | 3/1980 | Dostal et al. | 297/126 |
| 4,801,175 | * | 1/1989 | Albanese | 297/124 |
| 4,913,488 | * | 4/1990 | Donnell, Jr. | 297/124 |

* cited by examiner

*Primary Examiner*—Peter R. Brown
(74) *Attorney, Agent, or Firm*—Dykema Gossett PLLC

(57) ABSTRACT

A frame supports a fixed seat portion, and a common portion is pivoted on the frame for movement between a seat back position and a table top position. A locking device for retaining the common portion in the table top position has a manually operated end with an outer surface which is flush with the adjacent surface of a support when the device is in locked position to visibly indicate that the assembly is locked in position to serve as a table. When the locking device is unlocked, the outer surface of the manually operated end is spaced from the adjacent surface. The locking device includes wedging members adapted to be wedged between a support fixed to the common portion and the upper end of a frame member. When the locking device is in locked position, resilient arms bias projections thereon into a recess in the upper of the frame member to retain the device in position to serve as a table. A further positive lock is provided by inserting a rigid member through aligned holes in the support and an aligned notch in the locking device.

13 Claims, 4 Drawing Sheets

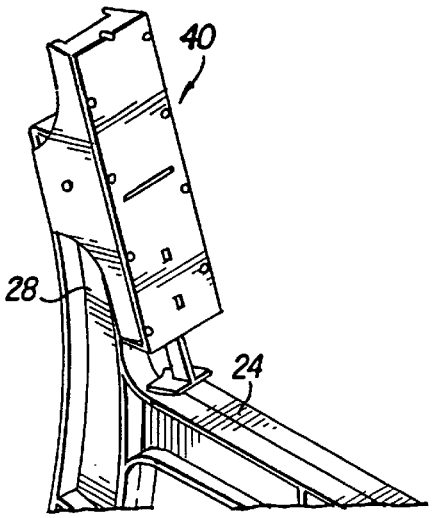
FIG. 4
FIG. 10
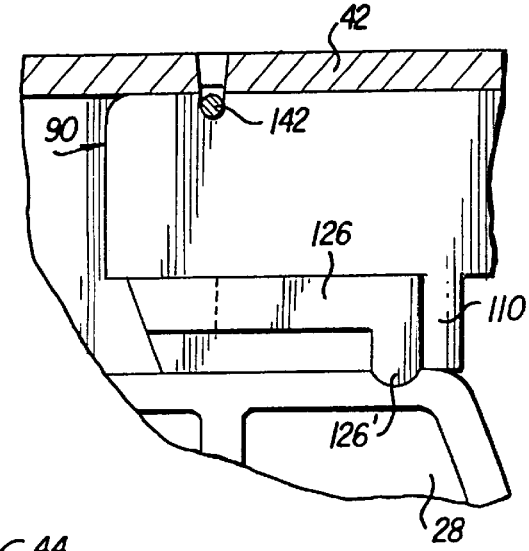
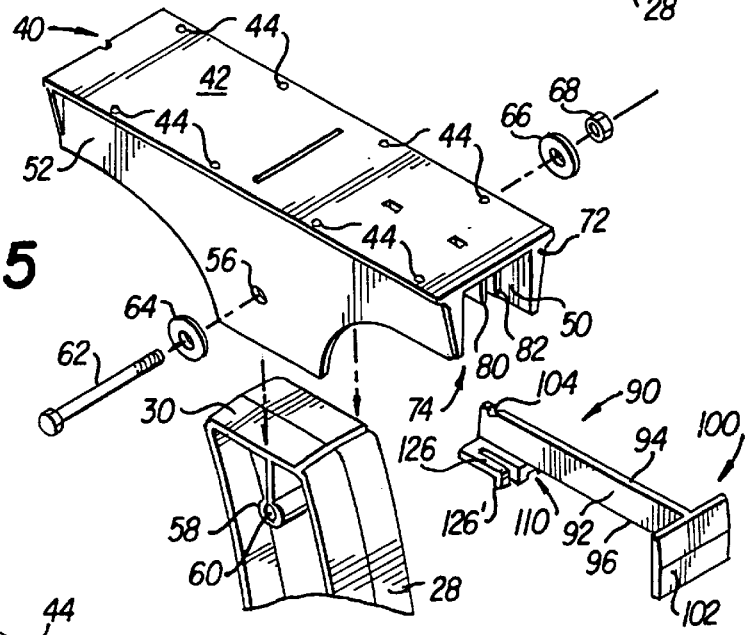
FIG. 5
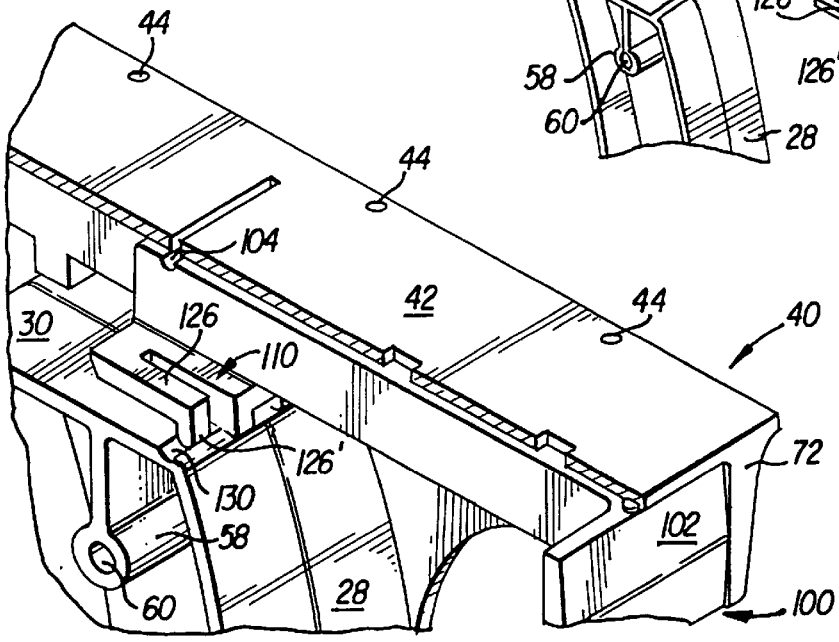
FIG. 6

CONVERTILE BENCH AND TABLE ASSEMBLY

BACKGROUND OF THE INVENTION

The present invention relates to a convertible bench and table assembly, and more particularly to an assembly wherein a frame is provided upon which a seat portion is fixed in position. The assembly also includes a common portion movably mounted on the frame for movement between an unlocked position where it is maintained by gravity to form a seat back and a locked position where it forms a table top. This invention is an improvement over similar assemblies shown in U.S. Pat. Nos. 4,194,784 and 4,913,488, the disclosures of which are incorporated herein by reference.

In the structures shown in the above-referenced patents, a movable locking member is provided at each end of the common portion, each locking member including a wedge portion adapted to be wedged between an upstanding frame portion and a support means which forms part of the common portion. In the construction of U.S. Pat. No. 4,194,784, the locking member incorporated a wedge portion for performing the function of locking the common portion in position. However, this arrangement did not prove entirely satisfactory. The construction of U.S. Pat No. 4,913,488 introduced additional means to maintain the locking member in locked position in the form of a projection defining a detent on the locking member which cooperates with a rib formed on the support means of the common portion.

The improved construction of U.S. Pat No. 4,913,488 has presented serious problems in use. A first problem is caused by the fact that the locking member is slidably disposed within a support means having walls which effectively hide the locking member from view so that a user cannot readily visibly determine whether the locking member is in fully locked position. The user must judge the degree of engagement of the detent with the rib more or less by feel, and with only fingertip contact with a small actuator. In fact, depending on the tolerances of the molded components, contact of the projection on the locking member with the rib can be inadvertently interpreted as a "stop" upon coming into contact with one another due to the tightness of their interference. Therefore, the user could believe that the common portion will be retained in locked in position, when, in reality, the detent and rib serve no such function. In other words, the user cannot readily ascertain that the common portion is securely retained in its locked position by feel or by any readily visible means.

A further problem with the construction shown in U.S. Pat No. 4,913,488 is that the projection on the locking member and the rib on the support means of the common portion may actually have little or no contact with one another because of the small size thereof, and improper or incomplete molding. Furthermore, the wooden members of the common portion tend to twist and warp with the passage of time, thereby deforming the support means of the common portion which causes the projection and the rib to be pulled out of contact with one another.

SUMMARY OF THE INVENTION

In the present invention, the locking device has an enlarged operating portion which is relatively thin so that it will fit within the palm of a user's hand and which enables the user to push and slide the locking device into locked position, and which further enables the user to grasp the lower edge portion of the operating portion with his fingers to pull and slide the locking device away from the support means of the operating portion to move the locking device into unlocked position.

The operating portion of the locking device has an outwardly facing surface. The support means which slidably supports the locking device also has an outwardly facing surface disposed on three of the four sides of the operating portion. When the locking device in its outward unlocked position, the outwardly facing surfaces on the operating portion and the support means are disposed in spaced relationship to one another. When the locking device in its inward locked position, these surfaces are flush with one another. In this manner the invention provides a readily visible indication of whether or not the locking device is in its locked position.

In the invention, the locking device comprises an elongated body means having wedging means extending downwardly from the lower surface of the body means. The wedging means is similar to that disclosed in the aforementioned patents. A pair of resilient arms are disposed adjacent to and spaced from opposite sides of the wedging means. An upper surface of an upstanding frame portion is provided with a recess which receives projections extending downwardly from the ends of the two resilient arms. These projections are resiliently biased into the recess to securely maintain the locking device in locked position. This provides an improved means for maintaining the locking device in locked position and avoids the problems encountered with the structures of the aforementioned patents.

In order to provided a more positive means for retaining the locking device in locked position, additional locking means is provided. The locking device is provided with a recess or notch; and the support means of the common portion has two parallel walls which have aligned holes formed therethrough. When the locking device is in locked position, the holes are aligned with the notch in the locking device. The aligned holes and notch can then receive a rigid member such as a nail or piece of heavy wire to positively prevent the locking device from being moved to unlocked position. It is apparent that the rigid member can be removed when it is desired to move the locking device to unlocked position.

BRIEF DESCRIPTION OF THE DRAWINGS

FIG. 4 is a view similar to FIG. 3 showing the parts in a different position;

FIG. 5 is an exploded top perspective view of components of the assembly;

FIG. 6 is an enlarged top perspective view partly broken away of components of the assembly;

FIG. 10 is a an enlarged view of the portion of FIG. 8 indicated by arrow 10—10 in FIG. 8.

DESCRIPTION OF THE PREFERRED EMBODIMENT

Figure 1:
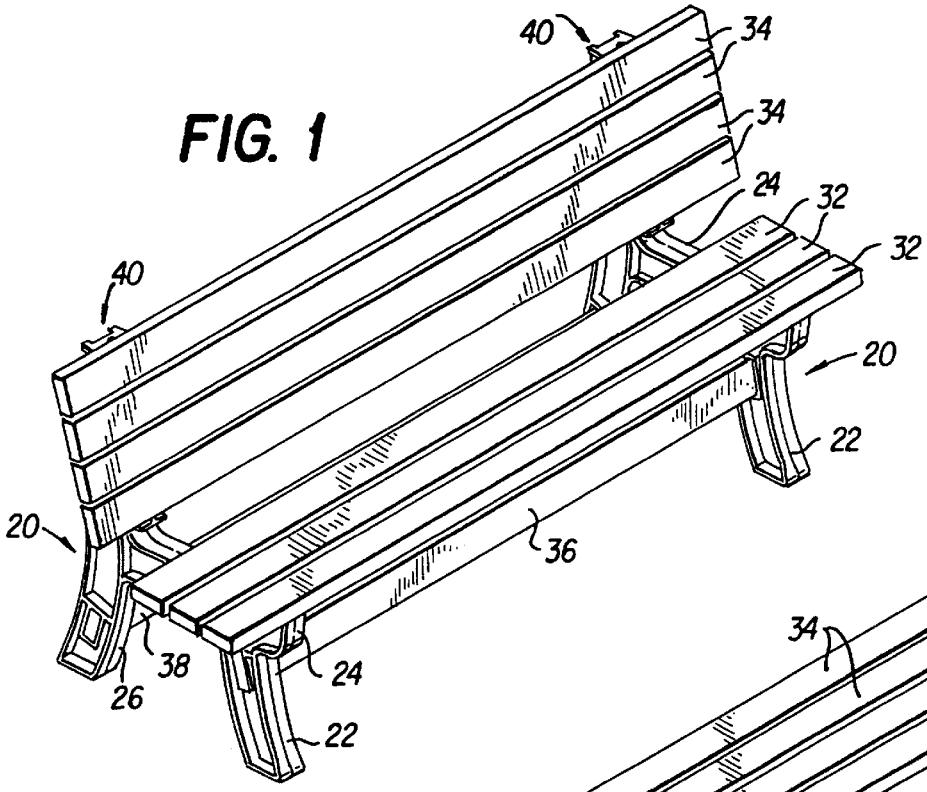
FIG. 1 is a top perspective view showing the assembly in position to serve as a bench.

Referring to FIGS. 1–6 of the drawings, frame means is provided in the form of a pair of similar rigid frame elements 20 each of which may be formed of an integral molded plastic material. Each element 20 includes a front leg portion 22 which joins with a horizontal portion 24 which in turn joins with a back leg portion 26 and an upstanding frame portion 28 which has a substantially flat upper surface 30 as seen in FIG. 5.

Figure 3:
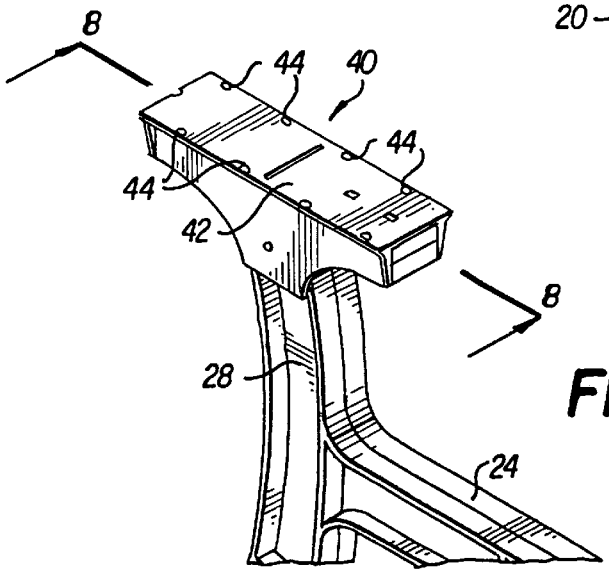
FIG. 3 is a top perspective view of a portion of the structure shown in FIG. 2.

A seat portion is formed by a plurality of elongated wooden members 32 which are supported in fixed position on horizontal portions 24 by bolts or screws (not shown) which pass through suitable holes (not shown) formed in portions 24. A common portion is formed by a plurality of elongated wooden members 34 which are supported in fixed position on two similar support means 40 which are pivotally supported at the upper ends of the upstanding frame portions 28 as described hereinafter. As seen in FIG. 3, each support means 40 includes an upper wall 42 having a plurality of spaced holes 42 formed therethrough for receiving bolts or screws (not shown) which pass therethrough for supporting members 34 in fixed position on the support means.

FIG. 1 shows the assembly in position to serve as a bench. In this position of the common portion of the assembly, the assembly locking device described hereinafter is in its unlocked position and the common portion is maintained by gravity in the position shown. FIG. 4 shows the interrelationship between the support means 40 and the associated frame element when the assembly serves as a bench. It is noted that a pair of elongated wooden members 36 and 38 extend between frame elements 20 and have the opposite ends thereof disposed within openings formed in the frame elements and being suitably secured thereto.

Figure 2:
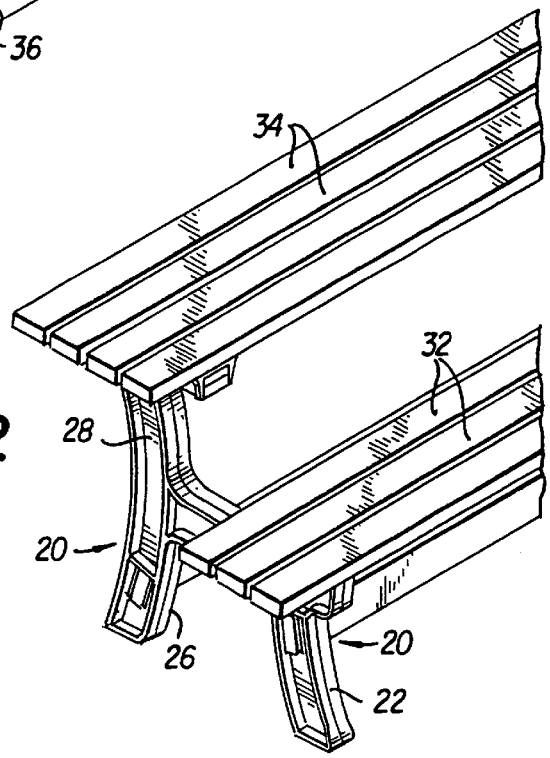
FIG. 2 is a partial top perspective view showing the assembly in position to serve as a table.

FIG. 2 shows the assembly in position to serve as a table. In this position of the common portion of the assembly, the assembly locking device is in its locked position to securely maintain the common portion in such position. FIG. 3 shows the interrelationship between the support means 40 and the associated frame element when the assembly serves as a table.

Referring to FIGS. 5–9, each support means 40 includes a pair of opposite side walls 50 and 52 which extend downwardly from upper wall 42. These side walls have aligned holes 54 and 56 formed therethrough respectively. Each upstanding frame portion 28 includes an integral boss 58 having a hole 60 formed therethrough. A threaded bolt 62 extends through a washer 64, hole 56, hole 60, hole 54, a washer 66, and has a nut 68 threaded on the end thereof to pivotally support each support means 40 on an associated upstanding frame portion 28.

Figure 7:
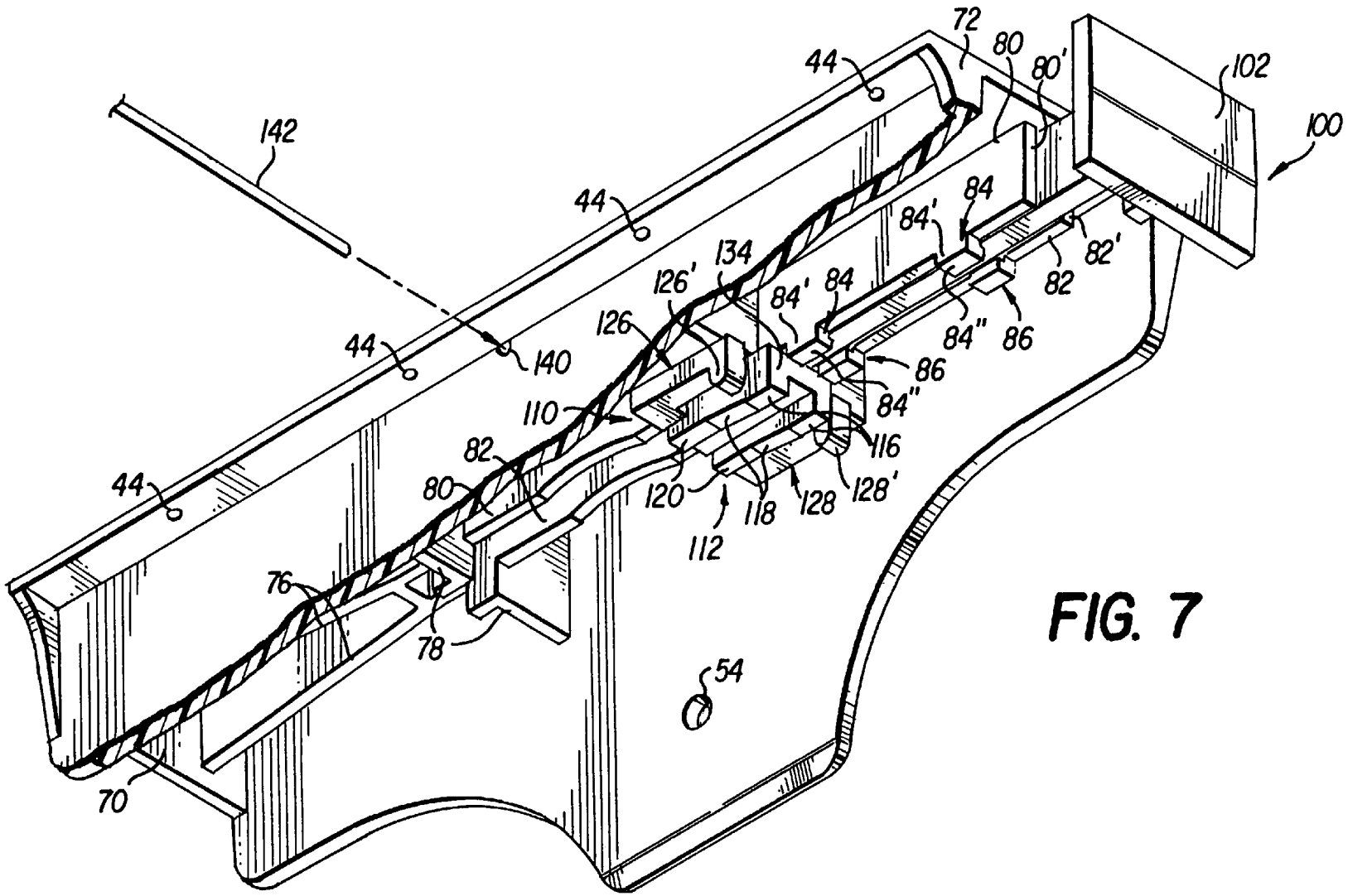
FIG. 7 is a bottom perspective view partly broken away of components of the assembly.

Each support means 40 also includes a back wall 70 and a front wall 72, the front wall defining a three sided opening 74 as seen in FIG. 5 for a purpose hereinafter explained. As seen in FIG. 7, reinforcing ribs 76 and 78 extend downwardly from the undersurface of the top wall of the support means which is preferably formed as an integral molded rigid material such as plastic. Also extending downwardly from the top wall are a pair of spaced guide rails 80 and 82. A first pair of spaced L-shaped tabs 84 are formed at the lower edge of rail 80. Each tab includes a downwardly extending vertical portion 84' which joins with an inwardly extending horizontal portion 84". A second pair of spaced L-shaped tabs 86 are formed at the lower edge of rail 82. The tabs 86 are of similar construction to tabs 84, the horizontal portions of tabs 84 extending inwardly toward portions 84" of tabs 40 for a purpose hereinafter described.

Referring to FIGS. 5–9, a locking device is formed as an integral molded plastic elongated body means 90 including a narrow portion 92 which is slidably disposed between guide rails 80 and 82. Portion 92 includes an upper surface 94 and a lower surface 96. The lower surface is supported on the horizontal portions of tabs 84 and 86 so that the locking device will be retained on the support means. An enlarged operating portion 100 is formed at one end of body means 90 and is adapted to be engaged by a user's hand. Operating portion 100 has an outwardly facing surface 102 thereon. Adjacent the opposite end of body means 90, the upper surface 94 thereof is provided with a notch 104 for a purpose hereinafter described.

Figure 9:
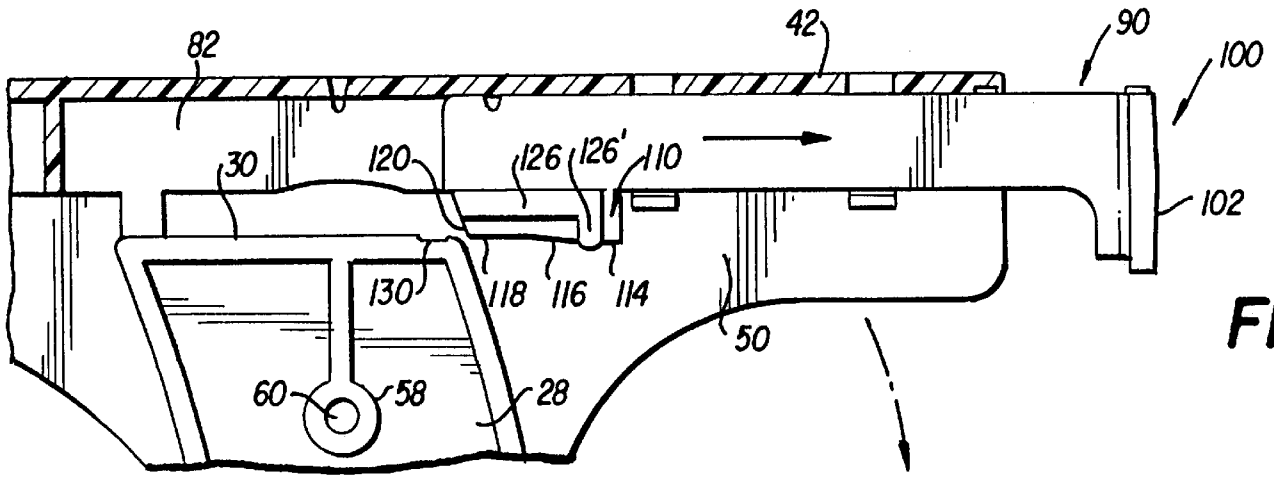
FIG. 9 is a view similar to FIG. 8 showing the components in a different position.

Also formed on the opposite end of body means 90 is a pair of spaced similar depending wedge portions 110 and 112 having parallel wedge surfaces formed at the lower edges thereof. The wedge means of the present invention is similar to the wedge means disclosed in the two aforementioned patents and each wedge portion includes four wedge surfaces 114, 116, 118, and 120 as seen in FIGS. 7 and 9.

Figure 8:
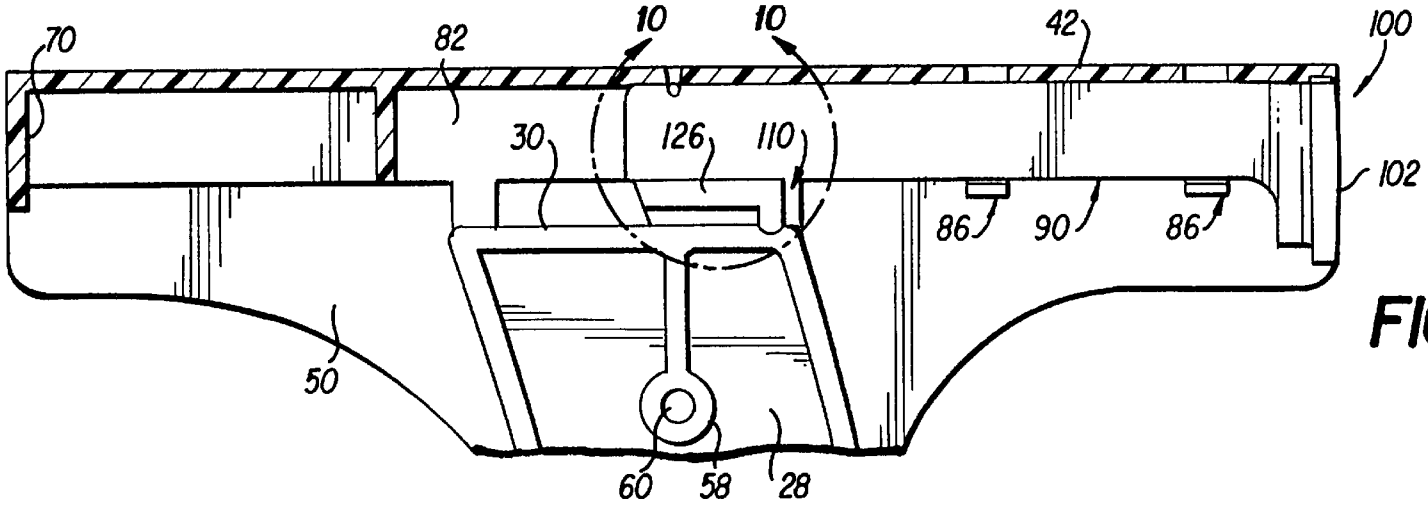
FIG. 8 is an enlarged sectional view taken along line 8—8 of FIG. 3

Also formed on the opposite end of body means 90 is a pair of spaced similar resilient arms 126 and 128 adjacent to and spaced on opposite sides of the wedge portions 110 and 112. The resilient arms have projections 126' and 128' extending downwardly therefrom and forming first locking means. A second locking means is in the form of a recess 130 as seen in FIG. 9 which is formed in the upper surface 30 of the upstanding frame portion 28. When the locking device is in locked position as shown in FIGS. 5 and 8, the projections on the resilient arms are disposed within recess 130 to securely lock the locking device in locked position with the wedge means wedged tightly between the undersurface of wall 42 of the support means and the upper surface 30 of the upstanding frame portion 28. It is also noted that in such locked position, the outwardly facing surface 102 of the operating portion of the locking device is flush with the front surface 72 of the support means. When the locking device is moved outwardly into its unlocked position as shown in FIG. 9, surface 102 of the operating device is spaced from surface 72 of the support means.

As seen in FIG. 7, outward movement of the locking device is limited by engagement of the face 134 on the locking device with tabs 84 and 86 on the guide rails. Inward movement of the locking device is limited by engagement of the inner face 138 on the operation portion 100 with the end faces 80' and 82' of guide rails 80 and 82 respectively.

Additional locking means is provided for positively locking the support means in locked position. Side walls 50 and 52 of the support means are provided with additional aligned holes 140, one of which is visible in FIG. 7. When the locking device is in locked position, the notch 104 formed in the top of the body means 90 is aligned with holes 140. A rigid member 142 such as a nail or a stiff wire is then inserted through the aligned holes and notch to prevent the locking device from being moved to unlocked position.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A convertible bench and table assembly comprising, frame means including an upstanding frame portion having an upper surface, a seat portion supported in fixed position on said frame means, a common portion movably mounted on said frame for movement between an unlocked position where it is maintained by gravity to form a seat back and a locked position where it forms a table top, said common portion including support means pivotally supported by said upstanding frame portion, a locking device carried by said support means for movement relative to said support means between a locked position and an unlocked position, said locking device having opposite end portions, said locking device including wedging means and first locking means adjacent one of said end portions, said first locking means being engageable with second locking means on said upper surface of the upstanding frame portion, said locking device including an operating portion adjacent another of said end portions of said locking device, said operating portion cooperating with said support means to provide a visible indication of whether the locking device is in locked position or unlocked position.

2. An assembly as defined in claim 1 wherein said first locking means includes a projection extending from said locking device, and said second locking means comprising a recess formed in said upper surface of the upstanding frame portion.

3. An assembly as defined in claim 2 wherein said projection is resiliently biased into said recess.

4. An assembly as defined in claim 1 wherein said wedging means and said locking means are disposed adjacent to one another.

5. An assembly as defined in claim 1 wherein said operating portion has an outwardly facing surface, said support means having an outwardly facing surface, said outwardly facing surfaces being flush with one another when the locking device is in locked position and being spaced from one another when the locking device is in unlocked position.

6. An assembly as defined in claim 1 including additional locking means for locking said support means in locked position, said support means including spaced portions having aligned holes formed therethrough, said locking device having a recess formed therein adapted to be aligned with said holes when the locking device is in locked position, said aligned holes and recess receiving a rigid member for additionally locking said support means in locked position.

7. A convertible bench and table assembly comprising, frame means including an upstanding frame portion having an upper surface, a seat portion supported in fixed position on said frame means, a common portion movably mounted on said frame for movement between an unlocked position where it is maintained by gravity to form a seat back and a locked position where it forms a table top, said common portion including support means pivotally supported by said upstanding frame portion, a locking device carried by said support means for movement relative to said support means between a locked position and an unlocked position, said locking device including an elongated body means slidably supported by said support means, said body means having an upper surface and a lower surface, wedging means extending downwardly from said lower surface of the body means for engaging said upper surface of the upstanding frame portion, said upper surface of the upstanding frame portion having a recess formed therein, said body means including a resilient arm disposed adjacent to and spaced from said wedging means, said resilient arm having an outer end portion including a locking portion resiliently engageable with said recess when the locking device is in locked position.

8. An assembly as defined in claim 7 including a second spaced resilient arm disposed adjacent to and spaced from said wedging means, said resilient arms being disposed on opposite sides of said wedging means.

9. An assembly as defined in claim 7 wherein said wedging means includes two parallel spaced wedging surfaces.

10. An assembly as defined in claim 7 wherein said upper surface of the body means of the locking device has a notch formed therein said, said support means including spaced portions having aligned holes formed therethrough, said notch being adapted to be aligned with said holes when the locking device is in locked position, said aligned holes and notch receiving a rigid member for additionally locking said support means in locked position.

11. A convertible bench and table assembly comprising, frame means including an upstanding frame portion having an upper surface, a seat portion supported in fixed position on said frame means, a common portion movably mounted on said frame for movement between an unlocked position where it is maintained by gravity to form a seat back and a locked position where it forms a table top, said common portion including support means pivotally supported by said upstanding frame portion, a locking device carried by said support means for movement relative to said support means between a locked position and an unlocked position, said locking device including locking means for locking said support means in locked position, said locking device including one end portion having an operating portion, said operating portion having an outwardly facing surface, said support means having an outwardly facing surface, said outwardly facing surfaces being flush with one another when the locking device is in locked position and being spaced from one another when the locking device is in unlocked position.

12. An assembly as defined in claim 11 wherein said locking device includes an elongated body means slidably supported by said support means, said support means including a pair of spaced guide rails for guiding movement of said elongated body means, and means on said guide rails for retaining said body means on said support means and for limiting inward and outward movement of said body means relative to said guide means.

13. An assembly as defined in claim 11 wherein said locking device has a notch formed therein, said support means including spaced portions having aligned holes formed therethrough, said notch being adapted to be aligned with said holes when the locking device is in locked position, said aligned holes and notch receiving a rigid member for additionally locking said support means in locked position.

* * * * *